US005366833A

United States Patent [19]

Shaw et al.

[11] Patent Number: 5,366,833

[45] Date of Patent: Nov. 22, 1994

[54] SECURITY DOCUMENTS

[76] Inventors: Joel F. Shaw, 64 Hobin St., Stittsville, Canada, K0A 3G0; Gary A. Van Beek, 3065 Mackey Road, North Gower, Canada, K0A 2T0

[21] Appl. No.: 35,356

[22] Filed: Mar. 22, 1993

[51] Int. Cl.[5] ..... G03G 15/22

[52] U.S. Cl. ..... 430/10; 430/47

[58] Field of Search ..... 430/10, 47; 428/13, 428/29, 76

[56] References Cited

U.S. PATENT DOCUMENTS 4,579,754 4/1986 Maurer et al. ..... 430/10

4,680,458 7/1987 Drexler ..... 430/10

4,903,254 2/1990 Haas ..... 368/327

*Primary Examiner*—John Goodrow

*Attorney, Agent, or Firm*—Robert A. Wilkes

[57] ABSTRACT

A method for making security documents using an electro photographic printer, particularly a photocopier or laser printer, includes the step of exposing the printed image to an accelerator, in liquid or vapour form. Under the influence of the accelerator, a second dye contained in the toner, used in producing the image, migrates into the document, thereby producing a second image in the paper in registration with the printed image. The process is applicable to images created on paper, security paper, and synthetic papers.

14 Claims, No Drawings

SECURITY DOCUMENTS

SECURITY DOCUMENTS

This invention relates to security documents which are printed, at least in part, by using an electro photographic printer. The most common examples of such a printer are the laser printer and the photocopier. For clarity, the term "laser printer" will be used herein. As is well known, in printing a document using either a laser printer or a photocopier essentially three steps are involved. An image pattern is produced, particulate toner is applied to the image pattern, and then the toner is transferred to and bonded to, the paper. Although most often used for black images, chiefly printed text, the production and copying of coloured images by these methods is becoming more common.

When a laser printer is used to produce at least a part of a security document, a well known disadvantage of the laser printer assumes more importance. The toner powder particles do not penetrate paper well, and consequently images produced in this way are, to a certain degree, at risk. Both deletion and modification of a printed image is possible. Nevertheless, laser printers continue to be used extensively in preparing security documents, especially those wherein the document is completed by filling in the blanks on a prepared form. Many security passes, passports, and visas for insertion into passports fall into this category. In order to overcome the known problems with laser printed documents, other steps are often taken to protect them, including the use of security papers, and sealing at least the printed face of the document with a tightly adhering plastic film.

These methods are not wholly successful. For example, the use of intaglio printed security paper whilst making the document more difficult to copy, only exacerbates the printing difficulties, as a laser toner is less adherent to such a paper than it is to an ordinary paper.

This invention seeks to overcome these difficulties by providing a laser printing process wherein both a printed image, and a migrated dye image in direct registration with the printed image, are produced in the document. In such a document, the directly printed image still is at risk, in the same way as any other laser printed image. But alteration of the migrated dye image is effectively impossible, without causing excessive, and therefore detectable, damage to the document.

It is known to incorporate a particular class of what may be called migrating dyes into a laser toner. This known toner is used in creating coloured images on fabrics, typically T-shirts and the like. In this process, a reversed image which looks to be black is produced on paper, using a laser printer. The paper carrying the image is then placed with the image side against the fabric which is to carry the design. Under conditions of some applied pressure (enough to ensure flatness) and heat a thermally labile dye is transferred from the apparently black toner to the surface of the fabric. In this process a detailed image is not possible, mainly due to the nature of the fabric onto which the image is transferred. The paper is only functioning as a carrier, and is discarded after use. The toners used in this thermal transfer process have been found to be applicable to the production of security documents by the printing process of this invention. Further, the polychromatic toners used in colour photocopiers also are useable in the printing process of this invention. Other toner compositions would be apparent to one of skill in the art.

Thus in a broad embodiment this invention seeks to provide a process for printing a security document which comprises:

(i) creating an image pattern by means of an electro photographic printer;

(ii) applying to the generated image, within the electro photographic printer, at least one particulate toner, which toner includes a first dye, and at least a minor proportion of a second dye;

(iii) transferring and bonding to at least one particulate toner to the surface of the document to provide a document including an electro photographically printed image; and (iv) exposing at least a part of the electro photographically printed image on the document to an accelerator in liquid or vapour form to cause a major proportion of the second dye to migrate into the document, in registration with at least a part of the electro photographically printed image.

In a preferred embodiment, the printer is a laser printer or a photocopier.

In another preferred embodiment of the invention, the document material onto which the printed image is applied is a non-paper synthetic printable material.

A large number of formulations are available for laser printer toners, which are also described as "ink", although this is an inaccurate term to use. For clarity, only the term "toner" will be used herein. Similarly, no distinction is usually drawn between the terms "dye" and "pigment" when describing the colouring agent used in a toner, even though these terms are not really synonymous. For clarity, only the term "dye" will be used herein. The commonest toner, used in the majority of laser printers, consists of resin carrier particles which are chemically treated so that even smaller dye particles cling to them. The commonest dyes are carbon black and ferrite, although many others are used, especially in polychrome reproduction. The resin carrier particles are preferably spherical, and have a diameter in the range of from 50 μm to 75 μm. The dye particles are also usually substantially spherical in shape, and have a diameter in the range of from 5 μm to 10 μm.

Most of the processing steps used in preparing a toner are concerned with the manufacture and grinding of the carrier, which may contain a colouring agent, and other compounds intended to control the properties of the particles. Only near the end of the process does the dry blending of surface additives and dye particles take place. The dye particles give the toner the desired colour. The additives are intended to give the final toner desirable properties, and serve several purposes, including controlling surface conductivity of the carrier particles, and ensuring that the toner has desirable flow characteristics in the printer cartridge. It is during this last preparation step that the second migratable dye is blended into the toner particles. Usually the only subsequent process steps are ones concerned with the grading of the final product to ensure consistency and uniform printing behaviour. Hence apart from including the second migratory dye, the toner of this invention is intended to function in exactly the same way as a conventional toner in the printer, and is prepared by essentially the same process. It is nevertheless essential that the second migratory dye does not interfere with either the toner preparation process, or the laser printing procedure, especially the step in which the toner is fused to the document surface. As is noted above, the currently available toners used in transfer printing onto fabrics, and in colour copiers meet these requirements.

The toners used in polychrome images present a special case. In black toners, the dye used is generally carbon black or ferrite, neither of which are migratable. In coloured toners, of which there are generally three, the colour is obtained by incorporating a single dye, or by using several dyes. Similarly, a given colour in the polychrome image may well often involve more than one toner colour. It is within the concepts of this invention to regard a minor proportion of a single coloured dye in a toner for a polychrome image as being the second migratable dye.

In order to create the second image, a small amount of an accelerator, in liquid or vapour from, is applied to the laser printed part of the document. How much of the laser printed image is treated is a matter of choice. The two main choices are how much of the image is to be treated, and, in the case of a polychrome image, which colours will contain a migratable dye. These will be decided based on the nature of the document, and its likely uses. The accelerator which is used is a small amount of an organic solvent, in which the migratable dye is at least partially soluble. Suitable accelerators include isopropanol, ethanol, methanol, acetone and methylethylketone.

The accelerator is applied to the desired part of the laser printed image by any suitable means, such as spray, exposure to vapour, brushing, and dipping. If only part of the image is to be treated, a suitable masking method is used.

When this invention is applied to a document which is printed on paper, it has been found that the migrated dye image sometimes is blurred somewhat, as the dye will sometimes tend to migrate sideways, as well as into, the paper. Thus although the migrated dye is in substantial registration with the original image, image quality and clarity often are lost to a degree in the migrated image. For some applications this is of little or no importance. But in some applications image quality, and fidelity with the original printed image, are important. It has been found quite surprisingly that the blurring effects often encountered with paper documents do not occur when the laser printed image is produced on one of the non-paper laser printable sheet materials now available. For clarity, these will be referred to as synthetic paper. These synthetic papers generally are sheet materials which have many of the attributes of paper, together with other properties not possessed by paper. For example, the material sold as "Teslin" (a trade mark of PPG Industries, Inc.) is described as a microporous, single layer, highly filled, plastic film, like paper, it appears to be made from fibres, but unlike paper it is extremely difficult to tear. The base material used in "Teslin" is stated to be of the polyolefin family, and the filler is stated to be silica. Another synthetic paper is the material known as "Tyvak".

It has been found that these synthetic papers, particularly "Teslin", have one unusual and unexpected property. It is well known that these materials can be printed using an ordinary laser printer. It has been found that the toners, referred to above, used in making transfer images can also be used in laser printing onto synthetic paper. However, when the laser image is exposed to the accelerator, for example liquid isopropanol, the second dye migrates directly into the synthetic paper to produce a migrated image having almost the same quality as the original image and with almost the same clarity. Indeed in many instances, especially on "Teslin", there is little discernable difference between the two images. It is therefore possible to produce a single image, which may include both alphanumeric information in both ordinary and machine readable form, and pictorial information, such as a computer generated likeness of a person, which can be viewed essentially from both sides of the document. Whilst modifying the laser printed image on the surface still is possible, modifying the migrated image, which is not only in the synthetic paper, but which also reproduces with significant fidelity the printed image, is extremely difficult without causing gross and visible damage to the synthetic paper sheet. It is thus apparent that using a laser toner which contains a migratable dye, and then printing onto a synthetic paper permits the preparation of a document which is significantly more resistant to tampering and alteration.

We claim:

1. A process for printing a security document which comprises:

(i) creating an image pattern by means of an electro photographic printer;

(ii) applying to the generated image, within the electro photographic printer, at least one particulate toner, which toner includes a first dye, and at least a minor proportion of a second dye;

(iii) transferring and bonding the at least one particulate toner to the surface of the document to provide a document including an electro photographically printed image; and (iv) exposing at least a part of the electro photographically printed image on the document to an accelerator in liquid or vapour form to cause a major proportion of the second dye to migrate into the document, in registration with at least a part of the electro photographically printed image.

2. A process according to claim 1 wherein the second dye forming the migrated image is a different colour to the printed image.

3. A process according to claim 1 wherein only a part of the printed image is exposed to the accelerator.

4. A process according to claim 1 wherein all of the printed image is exposed to the accelerator.

5. A process according to claim 1 wherein the printed image is black, and the migrated image is a different colour.

6. A process according to claim 1 wherein the printed image is polychromatic, and the second dye comprises a minor proportion of the coloured dye in the at least one toner.

7. A process according to claim 1 wherein the accelerator is an organic solvent.

8. A process according to claim 7 wherein the organic solvent is chosen from the group consisting of isopropanol, ethanol, methanol, acetone and methylethylketone.

9. A process according to claim 1 wherein the document is printed onto paper.

10. A process according to claim 9 wherein the document is printed onto security paper.

11. A process according to claim 1 wherein the document is printed onto synthetic paper.

12. A process according to claim 11 wherein the synthetic paper comprises a microporous, single layer, highly filled, polyolefin plastic film, wherein the filler is silica.

13. A process according to claim 1 wherein the electro photographic printer is a laser printer.

14. A process according to claim 13 wherein the electro photographic printer is a photocopier.

* * * * *